US007634097B2

(12) United States Patent
Niederdränk

(10) Patent No.: US 7,634,097 B2
(45) Date of Patent: Dec. 15, 2009

(54) HEARING AID

(75) Inventor: Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 864 days.

(21) Appl. No.: 11/200,477

(22) Filed: Aug. 9, 2005

(65) Prior Publication Data

US 2006/0029244 A1 Feb. 9, 2006

(30) Foreign Application Priority Data

Aug. 9, 2004 (DE) ..... 10 2004 038 669

(51) Int. Cl.
*H04R 25/00* (2006.01)

(52) U.S. Cl. ..... 381/315; 381/312; 381/314

(58) Field of Classification Search ..... 381/312, 381/314, 315, 317, 322, 323, 324, 98, 105, 381/107, 109
See application file for complete search history.

(56) References Cited

U.S. PATENT DOCUMENTS 4,425,481 A * 1/1984 Mansgold et al. ..... 381/317
4,947,432 A * 8/1990 Topholm ..... 381/315
5,524,150 A 6/1996 Sauer
5,592,079 A 1/1997 Scheel

FOREIGN PATENT DOCUMENTS

| | | | |
|---|---|---|---|
| DE | 28 22 672 | A1 | 11/1979 |
| EP | 0 557 847 | B1 | 9/1993 |
| JP | 05219589 | A | 8/1993 |
| WO | 9405965 | A1 | 3/1994 |

* cited by examiner

*Primary Examiner*—Huyen D Le

(57) ABSTRACT

The manner of informing a user about the current setting of manually adjustable parameters in a hearing aid is to be improved. In addition it is proposed that an information signal be transmitted to the user, on the basis of which said user is informed that an upper or lower end of the value range for a parameter to be set has been reached, so that further activation of the relevant actuator remains ineffective in respect of parameter setting. The invention is used in particular in conjunction with actuators which do not have a mechanical end stop, whereby the user could identify that the upper or lower end of the value range of the parameter to be set has been reached.

9 Claims, 1 Drawing Sheet

HEARING AID

CROSS REFERENCE TO RELATED APPLICATIONS

This application claims priority to the German application No. 10 2004 038 669.2, filed Aug. 9, 2004 which is incorporated by reference herein in its entirety.

FIELD OF INVENTION

The invention relates to a hearing aid having an actuator to continuously adjust at least one signal processing parameter.

BACKGROUND OF INVENTION

EP 0 557 847 B1 discloses a hearing aid which can be worn on the head, comprising an electrical signal path between a microphone and a receiver, in which the signal path can be adapted to different hearing situations/acoustic environments using means for electronically setting preprogrammable transmission parameters and a switching means for the hearing aid, with the switching means additionally controlling a signal emission device which emits at least one signal which is characteristic of the transmission parameter set for a specific hearing situation/acoustic environment, with the hearing aid user being able to perceive this signal and to be informed of the selected setting without removing the hearing aid from their head. This document also discloses that on first activation of a switching means within a predetermined period, only the signal emission device is enabled, as a result of which the user of the hearing aid receives information about the enabled transmission parameter without this being modified by activation of the switching means.

The use of digital actuators in particular for the manual setting of parameters in hearing aids is also known, said actuators not having a mechanical end stop.

DE 28 22 672 A1 discloses a function actuator for a computer-controlled message-related device. The known device has a knob with no mechanical stop. The values set are displayed by means of an LED chain.

SUMMARY OF INVENTION

An object of the present invention is to inform a user of the hearing aid about an ineffective manual activation of an actuator.

This object is achieved with a hearing aid or a hearing aid system with an input converter for receiving an input signal, a signal processing unit and an output converter for emitting an output signal that can be perceived by a user as an acoustic signal, with the user being able to be informed about settings or statuses of the hearing aid or hearing aid system by means of different information signals which are stored or generated in the hearing aid or hearing aid system, with the hearing aid or hearing aid system comprising at least one activatable actuator to modify at least one parameter influencing signal processing in the hearing aid or hearing aid system, said parameter being modifiable within a specific value range and with the actuator having no mechanical end stop by means of which the user can identify that the upper or lower end of the value range of the parameter has been reached, in that an information signal that can be perceived by the user can be emitted by the hearing aid or hearing aid system to indicate that the upper or lower end of the value range of the parameter has been reached as a result of activation of the actuator.

An input signal is received in a hearing aid by means of an input converter and converted to an electrical input signal. Typically at least one microphone receiving an acoustic signal serves as an input converter. Modern hearing aids frequently have a microphone system with several microphones in order to achieve reception as a function of the incident direction of acoustic signals or a directional characteristic. The input converters can nevertheless also comprise a telephone coil or an antenna to receive electromagnetic input signals. The input signals converted to electrical signals by the input converter are fed to a signal processing unit for further processing and amplification. To compensate for the individual hearing loss of a hearing aid wearer, further processing and amplification generally take place as a function of the signal frequency. The signal processing unit emits an electrical output signal, which is fed to the ear of the hearing aid wearer via an output converter, so that said wearer perceives the output signal as an acoustic signal. Receivers that generate an acoustic output signal are typically used as output converters. Nevertheless output converters for generating mechanical vibration are also known, which directly cause specific parts of the ear to vibrate, the ossicles for instance. Output converters are also known, which directly stimulate the nerve cells of the ear.

A plurality of different parameters can be adjusted in hearing aids with the aid of manually activatable actuators. A volume regulator is thereby used most frequently to adjust the volume. Other parameters, such as an increase or reduction of specific frequency ranges, the adjustment of specific sound controls, the adjustment of filters for noise signal suppression etc., can however also be set manually by means of actuators. Digital actuators are preferably used in digital hearing aids, emitting a value in the form of a digital number or pulse sequence at their output. In contrast to the trimmers or potentiometers used previously, these actuators allow a mechanical end stop to be dispensed with. As a result rotating actuators such as adjusting wheels or knobs can be rotated in the same direction for any length of time. The value range of the parameter to be modified by the relevant actuator is however naturally restricted so that in general no further effect is achieved once the upper or lower final value has been reached, even if the actuator is activated further.

Push buttons or rocker switches are also used to set parameters particularly in digital hearing aids. In contrast with trimmers or potentiometers, these do not have a mechanical end stop which indicates to the user that the upper or lower end of the value range of the parameter to be set has been reached. With certain parameters, the hearing program set for instance, once the highest program number, e.g. the hearing program 6 has been reached, it is possible to skip directly to the hearing program with the smallest program number, e.g. the hearing program 1, on further activation of an operating element to 'increment' the program number. However this is not advantageous for many settings, e.g. the volume setting. This type of parameter remains unmodified when the upper or lower end value has been reached, even on further activation of the actuator. This can irritate the user. It is thus proposed that when the upper or lower end of the value range is achieved for a parameter that can be modified by an actuator, an information signal is emitted that can be perceived by the user, to inform the user that the upper or lower end of the value range has been reached. To this end the hearing aid preferably emits a signal that is characteristic of the end value being reached. Different signals are advantageously generated for reaching the upper and/or lower limits of the value range.

A preferred development of the invention provides for an information signal to be emitted each time the volume regulator is activated, so that the user can identify the newly set volume.

This is advantageously achieved by adjusting the volume of the relevant information signal to the newly set volume. Other signal properties, such as signal duration, signal frequency or signal sequence, can also provides information about the volume setting. A voice output is possible for example, specifying a percentage in relation to the maximum value.

In another variant of the invention information about the current volume setting is also provided, even if the volume setting remains the same when this request is triggered. This can be achieved for example in that on first short-term activation of the volume regulator, an information signal relating to the current setting is initially emitted and the volume setting is only modified on subsequent activation of the volume regulator.

The invention enables a user to be informed at any time about the volume setting of their hearing aid, which is particularly important to them, this being possible without the need for an external acoustic input signal.

In conjunction with the invention it is worth noting that when an information signal is used for the current volume setting, this information signal differs clearly from the acoustic information signal to indicate that the upper or lower end of the value range for the volume setting has been reached, thereby avoiding confusion. In this context it should be noted in particular that the information signal for the current volume setting cannot simultaneously be the information signal to indicate that the upper or lower end of the value range for the volume setting has been reached, since the former is preferably emitted on each volume adjustment and the user would have to identify from the volume of this signal that the upper end value has been reached, which the user cannot be expected to do. The information signal to indicate that the upper or lower end of the value range for the volume setting has been reached should thus differ significantly from the information signal for the volume setting and should only be emitted when the upper or lower end value has been reached.

BRIEF DESCRIPTION OF THE DRAWINGS

The invention is now described in more detail on the basis of two figures.

DETAILED DESCRIPTION OF INVENTION

Figure 1:
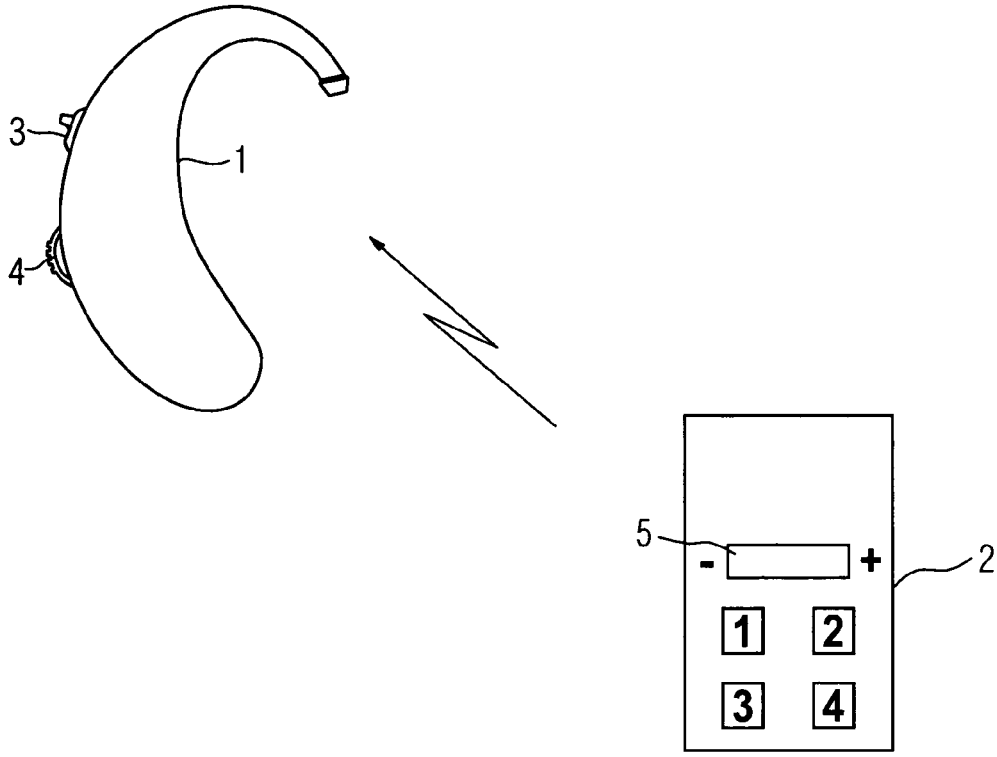
FIG. 1 shows a hearing aid system having a hearing aid and a remote control, and FIG. 2 schematically displays a control circuit for operating a hearing aid according to the invention.

The invention is described in more detail below with reference to an exemplary embodiment. The figure thereby shows a hearing aid system with a hearing aid 1 which can be worn behind the ear and a remote control 2 for wireless operation of the hearing aid 1. In addition to operation using the remote control 2, the hearing aid 1 also allows the direct operation by means of operating elements on the hearing aid 1. These operating elements in the exemplary embodiment are a program selection button 3 and a volume regulator 4. The volume regulator 4 is configured as a so-called digital volume regulator and has no end stops. It can thus be rotated in the same direction for any length of time. In contrast, the value range of a parameter regulating the volume is naturally restricted. The relevant parameter and the rotational movement of the volume regulator 4 are thereby tailored to each other, so that if the volume regulator 4 is rotated further after the upper or lower end of the value range has been reached, the upper or lower end value is maintained until the volume regulator 4 is rotated in the opposite direction.

The user is informed that the upper or lower end of the value range of the parameter regulating the volume has been reached by means of an acoustic signal that is characteristic of this situation. This signal can be generated by means of a signal generator in the hearing aid 1 or read out from a memory of the hearing aid 1. By way of example, this acoustic signal is a single short beeping tone when the lower limit is reached and two beeping tones in rapid succession when the upper limit of the volume setting is reached.

With the hearing aid system comprising the hearing aid 1 that can be worn behind the ear and the remote control 2, it is also possible to set the volume using the remote control 2. A rocker switch 5 is provided for this purpose with the volume being reduced by applying pressure to the left side and the volume being increased by applying pressure to the right side. Such regulation can naturally also only be achieved in the range between total muting of the hearing aid 1 the maximum possible volume setting. If the button 5 for decrementing and/or incrementing the volume is activated further once the final values have been achieved, this has no further effect on the hearing aid 1 in terms of volume adjustment. This cannot be identified by the user with a conventional hearing aid, particularly if no external input signal is present, from which the user could identify the current amplification setting and thus the current volume setting.

With the invention this problem is solved even when using the remote control 2, in that an acoustic signal is emitted in the same manner as when activating the volume regulator 4, when the upper or lower limit of the parameter regulating the volume has been reached, informing the user that the respective limit has been reached.

In a preferred embodiment of the invention a short tap on the rocker switch 5 does not cause the volume to be modified immediately but initially only generates a signal which informs the user of the current volume setting. This can preferably be achieved by emitting a signal with the volume corresponding to the volume setting even if no external acoustic input signal is present. In this way the user can be informed acoustically at all times about the current volume setting.

Figure 2:
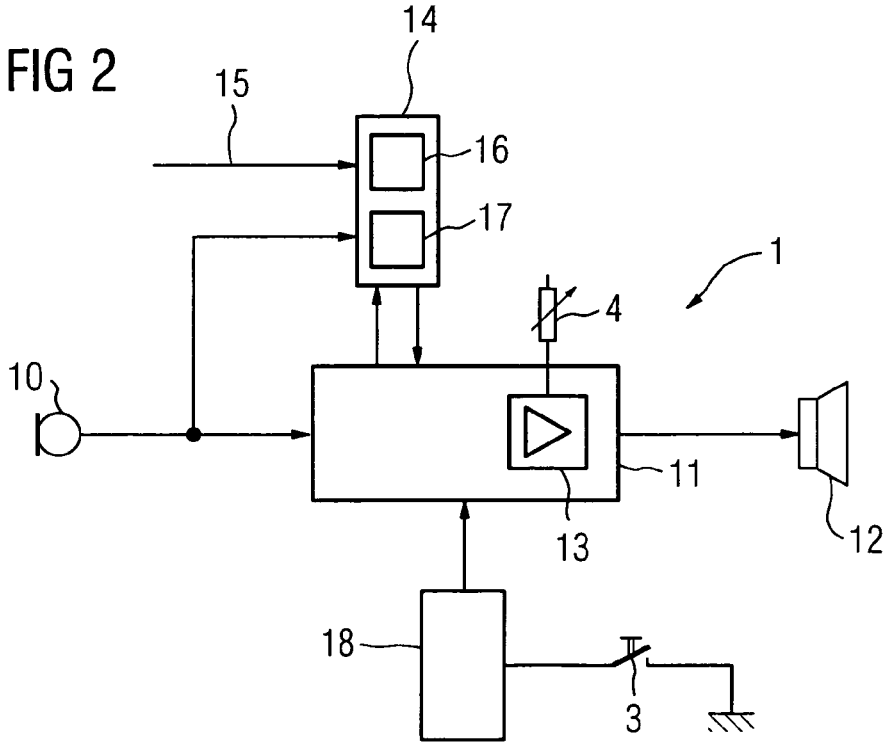

FIG. 2 shows the hearing aid 1 according to FIG. 1 in a considerably simplified block diagram. In this a microphone 10 receives an acoustic input signal and converts said input signal to an electrical input signal. This is fed to a signal processing unit 11 for further processing and frequency-dependent amplification, the output signal of said signal processing unit being converted to an acoustic signal by a receiver 12 and being fed to the ear of a hearing aid wearer. For final amplification of the electrical signal fed to the receiver 12, the signal processing device 11 comprises a final amplifier 13. This is preferably configured with digital circuit technology and can be adjusted in terms of its amplification by the volume regulator 4.

According to the invention, the hearing aid 1 comprises means 14 for emitting information signals. The information signals are transmitted to the hearing aid 1 from the outside via the electrical signal path 15 or via the microphone 10 and are stored in a memory 16. The hearing aid 1 can however also comprise a signal generator 17 for the internal generation of information signals. The hearing aid 1 according to the exemplary embodiment further comprises a memory 18 for several hearing programs, one of which is switched to active in each instance and momentarily influences signal processing in the signal processing unit 11. The program selection button 3 allows switching between different hearing programs. Each time the program selection button 3 is activated, the program number of the set hearing program is increased by one, until the highest program number is achieved, e.g. the hearing program 6, when further activation of the program selection button 3 causes the unit to switch to the hearing program with the lowest program number, the hearing program 1.

After to each switch, an acoustic information signal is output in each instance by the means 14 for generating information signals, comprising a number of beeping tones for example, the number of which corresponds to the current program number.

Furthermore, according to the invention, an acoustic information signal is emitted each time the volume regulator 4 is activated, to inform the user of the current volume setting.

The invention claimed is:

1. A hearing aid, comprising:

an input converter for receiving an input signal;

a signal processing unit connected to the input converter;

an output converter for emitting an acoustic output signal, the output signal:

perceivable by a user of the hearing aid, representing a setting or status of the hearing aid, and comprising a plurality of information signals stored in or generated by the hearing aid; and at least one activatable actuator for adjusting a volume parameter of the hearing aid, the volume parameter having a specified value range, and the actuator lacking a mechanical end stop for defining a upper or lower end of the value range, wherein the plurality of information signals includes at least one acoustic limit signal for indicating to the user that the upper or lower end of the value range has been reached as a result of the user's activating the actuator.

2. The hearing aid according to claim 1, wherein the actuator is an adjusting wheel or a knob continuously rotatable in at least one rotational direction.

3. The hearing aid according to claim 1, wherein the actuator is a rocker switch having two non-stable switching positions and one stable central position.

4. The hearing aid according to claim 1, wherein the actuator comprises at least a first and a second push button, the first push button configured to increment a value of the parameter, and the second push button configured to decrement the value of the parameter.

5. The hearing aid according to claim 1, wherein the plurality of information signals includes at least one acoustic volume signal for indicating to the user a current volume setting.

6. The hearing aid according to claim 5, wherein a volume of the volume information signal is adjusted to the current volume setting.

7. The hearing aid according to claim 1, further comprising an operating element for retrieving a current volume setting without changing the volume, wherein the plurality of information signals includes at least one volume setting signal emitted upon the user's actuating the operating element, the at least one volume signal setting representing the current volume setting.

8. The hearing aid according claim 1, wherein the actuator is configured to generate a digital or a pulse-type actuating signal.

9. A hearing aid system, comprising:

at least one hearing aid; and a remote control as a unit separate from the hearing aid for controlling the hearing aid, the hearing aid comprising:

an input converter for receiving an input signal;

a signal processing unit connected to the input converter;

an output converter for emitting an acoustic output signal, the output signal:

perceivable by a user of the hearing aid, representing a setting or status of the hearing aid, and comprising a plurality of information signals stored in or generated by the hearing aid; and at least one activatable actuator included in the remote control for adjusting a volume parameter of the hearing aid, the volume parameter having a specified value range, and the actuator lacking a mechanical end stop for defining a upper or lower end of the value range, wherein the plurality of information signals includes at least one acoustic limit signal for indicating to the user that the upper or lower end of the value range has been reached as a result of the user's activating the actuator.

* * * * *